US006145269A

United States Patent [19]

Fisher

[11] Patent Number: 6,145,269

[45] Date of Patent: Nov. 14, 2000

[54] V-SHAPED FORMER FOR STACKING TRUSS

[75] Inventor: Mark E. Fisher, London, United Kingdom

[73] Assignee: Tomcat Global Corporation, Midland, Tex.

[21] Appl. No.: 09/169,746

[22] Filed: Oct. 9, 1998

[51] Int. Cl.[7] ..... F04B 1/343

[52] U.S. Cl. ..... 52/726.2; 52/650.1; 52/585.1; 52/655.1

[58] Field of Search ..... 52/633, 650.1, 52/650.2, 652.1, 653.1, 653.2, 657, 693, 695, 585.1, 655.1, 726.2

[56] References Cited

U.S. PATENT DOCUMENTS

D. 402,042 12/1998 Fisher ..... D25/61
5,205,101 4/1993 Swan et al. .
5,311,706 5/1994 Sallee ..... 52/2.18
5,390,463 2/1995 Sollner ..... 52/726.2
5,704,169 1/1998 Richter ..... 52/81.2

FOREIGN PATENT DOCUMENTS 859752 11/1956 United Kingdom .
1088460 7/1965 United Kingdom .
1320777 6/1969 United Kingdom .

*Primary Examiner*—Beth A. Stephan
*Attorney, Agent, or Firm*—Jones, Day, Reavis & Pogue

[57] ABSTRACT

A former in the shape of a substantially V-shaped body having an apex and two legs depending from the apex for use in assembling an elongated V-shaped truss that has a plurality of the formers removably attached to a plurality of associated elongated support chords to form a truss that may be disassembled for shipping.

10 Claims, 4 Drawing Sheets

V-SHAPED FORMER FOR STACKING TRUSS

BACKGROUND OF THE INVENTION

1. Field of the Invention

The present invention relates in general to stacking trusses and in particular to a V-shaped former for forming a demountable stackable truss 2. Description of Related Art Including Information Disclosed Under 37 CRF 1.97 and 1.98

In copending patent application Ser. No. 08/902,404, filed Jul. 29, 1997, and entitled "TRUSS", commonly owned by the assignee herein, and incorporated herein by reference in its entirety, there is disclosed a V-shaped stackable truss for use in construction of staging and the like.

In the prior art, such staging trusses were not stackable nor could they be disassembled and consequently they took up a great deal of space during shipment from location-to-location where they had to be assembled into a staging complex. Thus the commonly assigned copending patent application disclosed a V-shaped truss that could be stacked and therefore could be shipped with much less space.

Also, in a second commonly assigned copending application Ser. No. 09/169,488, filed of even date herewith, and entitled "Method and Apparatus for Assembling a Lightweight Stackable Truss", and also incorporated by reference herein in its entirety, there is disclosed a V-shaped stackable truss that could be disassembled and shipped in the disassembled stage and then reassembled to form a stackable truss at the location where the staging was to be constructed. This enabled the shipping of the units in a very tight, compact manner, thus allowing truss elements to be shipped at a much more economical rate. In that application, there was disclosed a V-shaped former that could be removably connected to an elongated chord or support member, such as a hollow tube, at its apex and at the outer end of each of its two depending legs. By removably attaching a plurality of spaced V-shaped formers to three chords or support members, a stackable V-shaped truss was obtained that could be disassembled and the parts shipped in their disassembled state.

The present invention relates to the V-shaped formers themselves and their novel construction.

SUMMARY OF THE INVENTION

The present invention discloses first and second embodiments of a V-shaped former that can be easily and removably attached to elongated chords (such as tubing support members) at its apex and at the outer end of each of the legs to form a V-shaped stackable truss. There is a bracket at the body apex and at each leg outer end for receiving the corresponding elongated chord or support member. Further, there is an attachment device for detachably connecting each of the brackets to a corresponding one of the elongated support members such that a plurality of the elongated support members and a plurality of the V-shaped formers may be detachably assembled to each other to form a V-shaped stackable truss for use and for storage and that may be disassembled for shipping.

In one embodiment, the bracket device is a tubular segment or base having a diameter sufficiently large to slidably receive an elongated tubular chord or support member.

In the preferred embodiment, the bracket device is an arcuate segment having a concave shape for receiving an elongated support member having a matching convex outer surface. A plate extends vertically outwardly from each of the arcuate segments for insertion in a corresponding slot in one of the elongated support members. Aligned orifices in the plate and the elongated support member enable a removable pin to be inserted therein to detachably connect the plate to its corresponding elongated support member.

The V-shaped former may be made of lightweight aluminum or reinforced plastic such as carbon fiber reinforced plastic.

In another embodiment, the V-shaped former has at least one flat surface on each depending leg. A first orifice in formed in each flat surface so that inverted V-shaped formers may be overlapped or placed on one another, flat surface aligned with flat surface, and first orifice aligned with first orifice, so that a pin can be inserted in each of the aligned orifices in each overlapping leg pair to create a truss former enabling an elongated truss having a first shape to be created.

By forming a second flat surface with a second orifice on each depending leg that is spaced from the first flat surface, inverted ones of said V-shaped former may be placed on each other in overlapping relationship with second orifice aligned with second orifice to create a truss former that enables the formation of an elongated truss having a second shape.

By forming a third flat surface with a third orifice on each depending leg that is spaced from the first and second flat surfaces, inverted ones of said V-shaped formers may be placed on each other in overlapping relationship with third orifices aligned to create a truss former that enables the formation of an elongated truss having a third shape.

The truss shapes, from an end view, may be square, rectangular, or six sided depending on the number of spaced flat surfaces formed in the legs and the choice of the pair of flat surfaces to be used.

Thus, it is an object of the present invention to provide a novel V-shaped former that can be easily and removably attached to corresponding elongated support members at its apex and at the outer end of each of its legs.

It is still another object of the present invention to provide a V-shaped former for forming a V-shaped stackable truss where a bracket device at the apex and at the outer end of each of the two depending legs is detachably connected to an elongated support member at the apex and at the outer end of each leg to form a V-shaped stackable truss that is easily disassembled and the parts shipped in the disassembled state.

It is also an object of the present invention to provide a V-shaped former that has an arcuate segment at its apex and at the outer end of each of its two depending legs that has a concave shape for receiving a tubular shaped elongated member for forming the V-shaped truss.

It is another object of the present invention to provide a V-shaped former having an arcuate segment at its apex and at the outer end of each of its two legs with a plate extending vertically outwardly from each of the arcuate segments in the normal position of use for insertion in a slot in a tubular support member that is received by the arcuate segment and that can be removably attached thereto.

It is yet another object of the present invention to provide a V-shaped former having a bracket device at its apex and at the outer end of each of the legs thereof in the shape of a hollow tubular segment with a first inside diameter for slidably receiving an elongated tubular chord or support member with a second smaller outside diameter in order to form a V-shaped truss using a plurality of the formers and three of the tubular support members.

It still another object of the present invention to provide a V-shaped former that has at least one, but preferably a plurality of, spaced flat surfaces with an orifice therein on the depending legs of the V-shaped formers such that two of the V-shaped formers can be inverted with respect to, and placed on, each other to create a former that enables an elongated truss of various shapes to be formed.

Thus, the present invention relates to a former for use in forming an elongated V-shaped truss that comprises a plurality of the formers and a plurality of associated elongated chords or support members. The former comprises a substantially V-shaped body having an apex and two legs depending at an angle from the apex, each leg having an outer end. A bracket device is formed at the body apex and at each leg outer end for receiving a corresponding elongated support member. An attachment device is used to detachably connect each of the bracket devices to a corresponding one of the elongated chords or support members such that a plurality of the elongated chords or support members and a plurality of the formers may be detachably assembled to each other to form a V-shaped truss that may be stacked for storage and that may be disassembled for shipping.

BRIEF DESCRIPTION OF THE DRAWINGS

These and other features of the present invention will be more fully disclosed when taken in conjunction with the following Detailed Description of the Preferred Embodiment(s) in which like numerals represent like elements and in which.

DETAILED DESCRIPTION OF THE PREFERRED EMBODIMENT(S)

Figure 1:
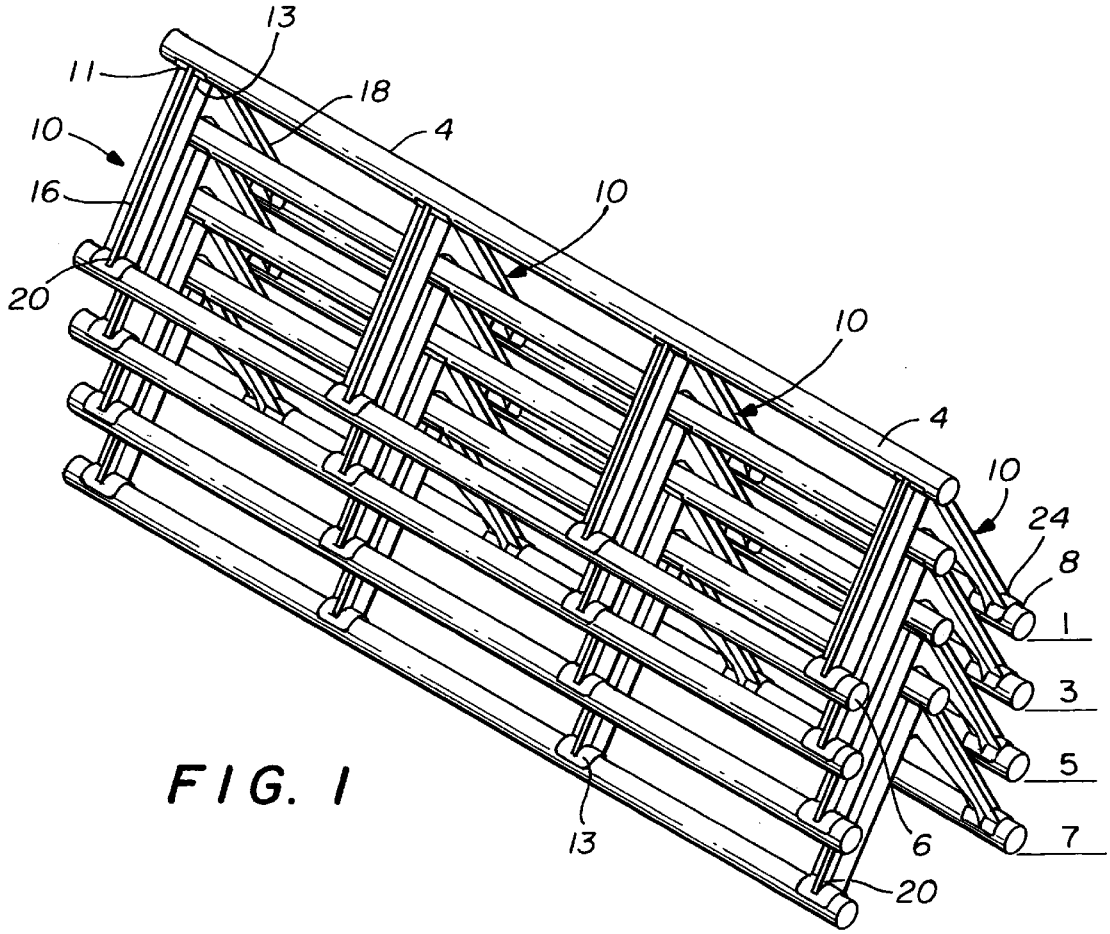
FIG. 1 is a perspective view of stacked trusses using the preferred embodiment of the formers of the present invention.

FIG. 1 is a perspective view of a plurality of V-shaped stacked trusses that are formed with the former of the preferred embodiment of the present invention.

In FIG. 1 it can be seen that there are four trusses, 1, 3, 5, and 7 that are V-shaped and, in inverted form, are stacked on top of each other. Each of these trusses is formed by removably attaching three elongated chords or supports 4, 6, and 8 to the apex 11 and the outer ends 20 and 24 of the V-shaped formers 10. The elongated support members 4, 6, and 8 may be in the form of elongated hollow chords or tubes as shown. It is obvious, however, that other shapes could be available provided that they have a surface that at least a portion of which matches the surface of bracket 13 at the apex and brackets 20 and 24 at the outer end of each of the legs 16 and 18.

Figure 2:
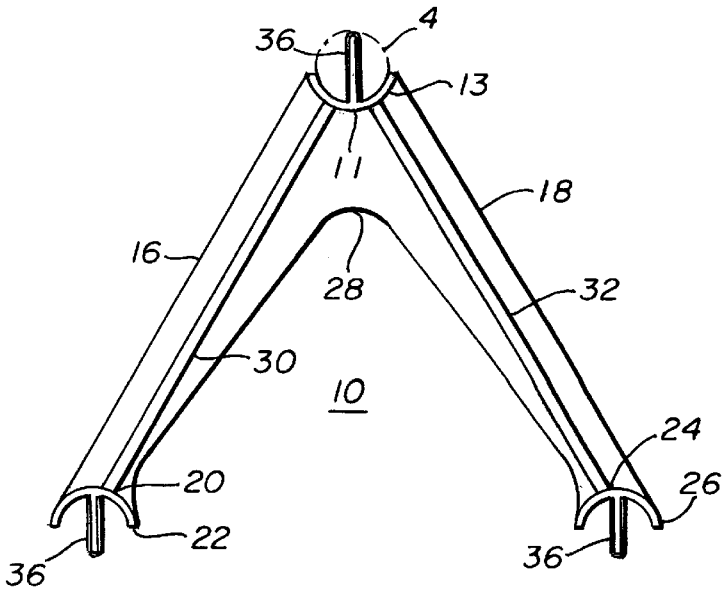
FIG. 2 is a front view of the preferred embodiment of the former.

FIG. 2 is a front view of the novel former 10 of the present invention. It can be seen that it has an apex 11 and two outer depending legs 16 and 18 which depend downwardly and outwardly in the form of an inverted V from the apex 11. Each leg 16 and 18 has a corresponding outer end 20 and 24. The bracket 13 at the apex 11 is in the form of an arcuate segment as shown and can receive a tubular shaped elongated support member as illustrated by the phantom lines 4. A bracket 36 extends vertically upwardly from the apex 11 and is used to be inserted in a slot, not shown, in the elongated chord or tubular member 4.

Outer end 20 also has a bracket formed as an arcuate segment 22 with a plate 36 extending vertically downwardly therefrom. In like manner, the outer end 24 of leg 18 has a bracket in the form of an arcuate segment 26 again with a plate 36 extending vertically downwardly therefrom. Each of the legs 16 and 18 has corresponding perpendicularly attached brace members 30 and 32 to strengthen the legs 16 and 18 although they may not be needed. There is a corresponding perpendicular leg on the opposite side of legs 16 and 18 that cannot be seen in FIG. 2 but one of which can be seen in FIG. 3 as strengthening brace member 34. At the junction of the two legs 16 and 18, there is an arcuate portion 28 which enables the assembled trusses to be stacked as shown in FIG. 1.

Figure 3:
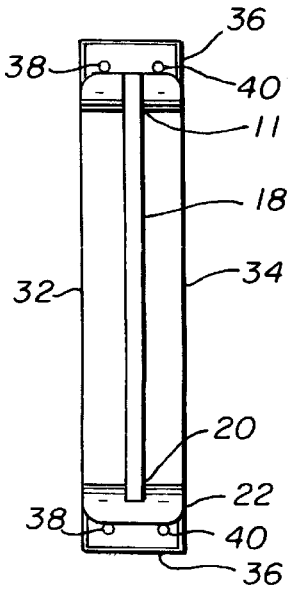
FIG. 3 is a side view of the preferred embodiment of the former.

FIG. 3 is a side view of the preferred embodiment of the former of the present invention as shown in FIG. 2. The additional strengthening brace member 34 can be seen extending outwardly perpendicular to the leg 18.

It can be seen in FIG. 3 that orifices 38 and 40 are formed in each of the vertically extending plates 36 to enable them to be attached to the tubular chords or support members 4, 6, and 8 by aligning them with preformed slots in the elongated tubular support members. Such connections are disclosed in detail in commonly assigned copending application Ser. No. 09/169,488, entitled "Method and Apparatus for Assembling a Lightweight Stackable Truss", filed of even date herewith and which is incorporated herein by reference in its entirety.

Figure 4:
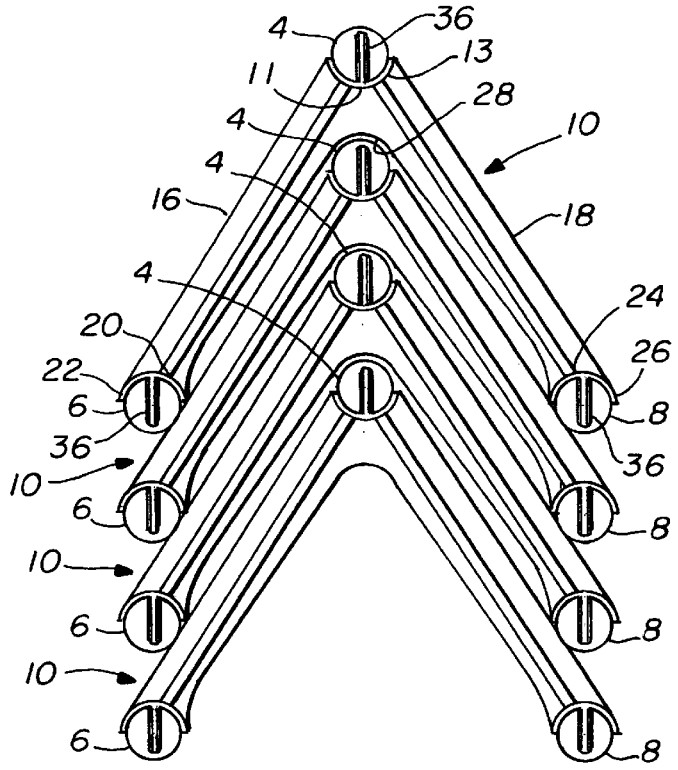
FIG. 4 is a end view of stacked formers of the preferred embodiment.

FIG. 4 is an end view of the stacked trusses utilizing the preferred embodiment of the formers of the present invention. Each of the formers 10 has an elongated tubular support member 4 attached to the plate 36 in the apex thereof In like manner, an elongated tubular member 6 is attached to the plate 36 at the outer end 20 of each of legs 16. Further, an elongated tubular member 8 is attached to the outer end 24 of each of legs 18.

As stated in relation to FIG. 3, orifices 38 and 40 are formed in each of the plates 36 in alignment with corresponding orifices, not shown here, in the corresponding elongated tubular support members 4, 6, and 8. The details are shown, as stated earlier, in commonly assigned copending application Ser. No. 09/169,488.

Thus, the embodiment allows stackable V-shaped trusses to be made quickly and efficiently and allows them to be shipped in disassembled state and assembled at the site where the V-shaped trusses are to be utilized. Thus there is a great advantage over the fixed V-shaped trusses of the prior art.

Figure 5:
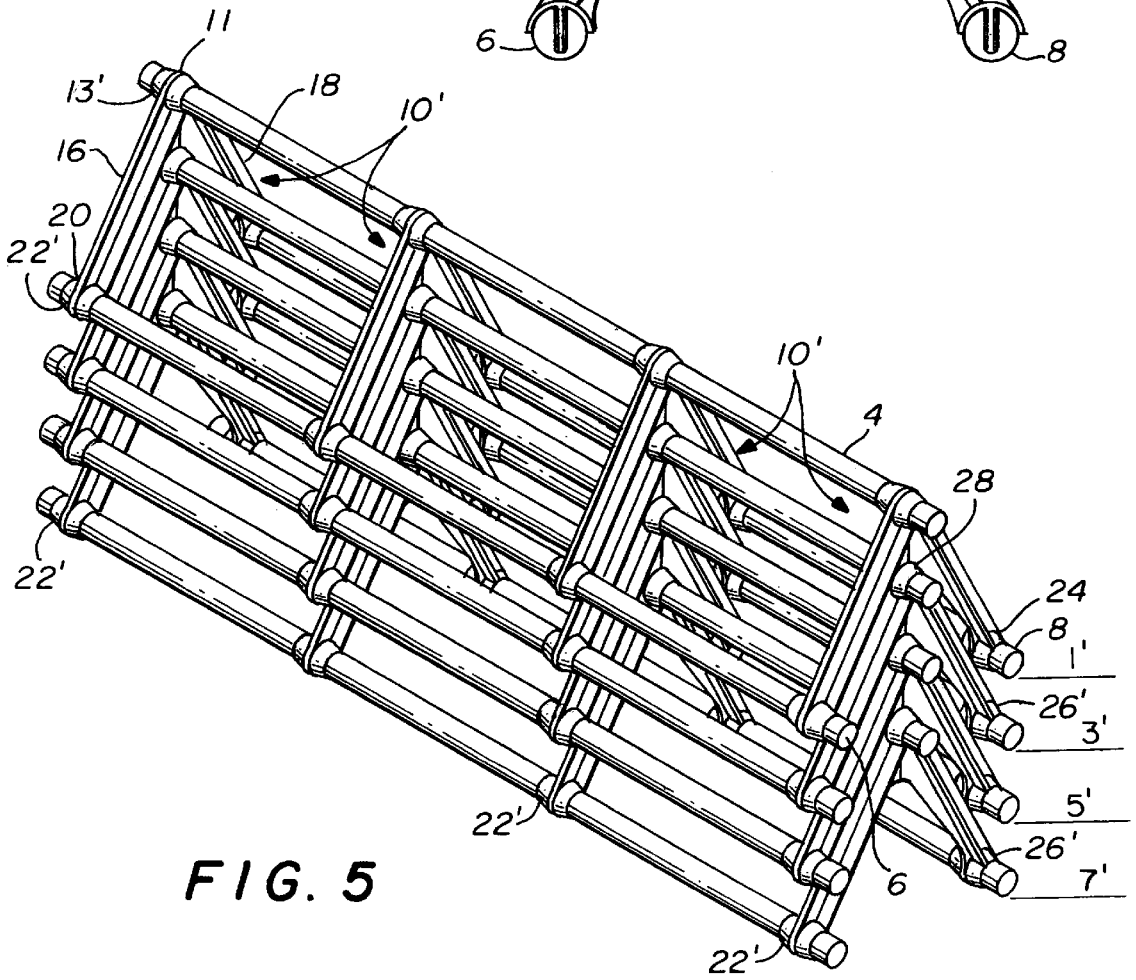
FIG. 5 is a perspective view of stacked trusses using the formers of the second embodiment of the present invention.

A second embodiment of the formers may be utilized to form a plurality of V-shaped stacked trusses as illustrated in FIG. 5, which is a perspective view of the stacked trusses. Again, there are a plurality of trusses 1', 3', 5', and 7'. In this embodiment, elongated chords or tubular support members 4, 6, and 8 are slidably inserted in brackets 13', 22', and 26' formed at the apex 11 and at the outer ends 20 and 24, respectively, as will be shown in more detail hereafter. The brackets 13', 22', and 26' are formed of hollow tubular segments having an inside diameter slightly greater than the outside diameter of the elongated chords or tubular support members 4, 6, and 8. Therefore, the elongated tubular segments 4, 6, and 8 can simply be slid through the corresponding bracket 13' at the apex, bracket 22' at one of the lower legs, and bracket 26' at the other lower leg outer end.

Figure 6:
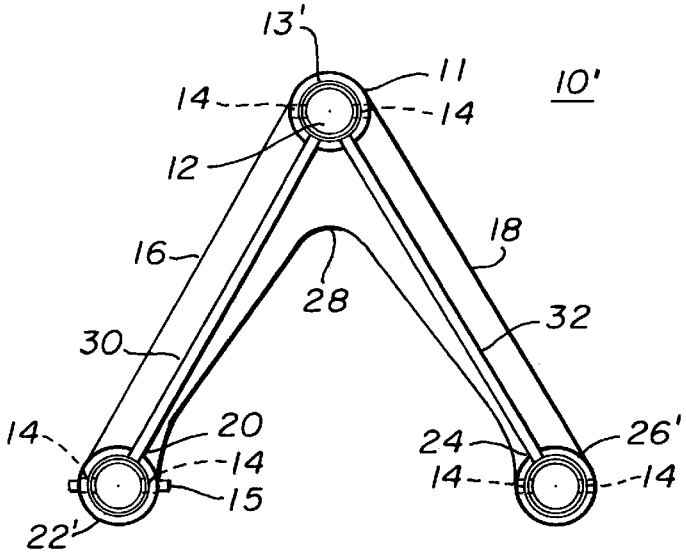
FIG. 6 is a front view of a former of the second embodiment.

A detailed front view of the former of the second embodiment is illustrated in FIG. 6. The former 10', again, has an apex 13' and two depending legs 16 and 18. The outer end 20 of leg 16 has a bracket device in the form of a hollow cylindrical duct segment 22'. In like manner, at the outer end 24 of leg 18, there is a hollow cylindrical duct segment 26' that can be better seen in FIG. 7. The hollow inside 12 of each duct segment slidably receives an elongated chord or tubular support member 4, 6, or 8 as described earlier and as shown in FIG. 5. At least one orifice 14 may be formed in each of the hollow duct segments 13', 22', and 26' in alignment with corresponding orifices in the elongated tubular support members 4, 6, and 8 so as to removably connect the two together. A pin 15 is illustrated in FIG. 6 extending through orifices 14 in the hollow cylindrical duct segment 22' at the outer end of depending leg 16 and corresponding orifices in said elongated chord (not shown here).

Figure 7:
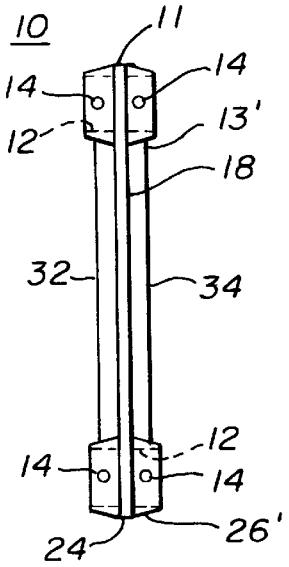
FIG. 7 is a side view of the former of FIG. 6.

The orifices 14 can better be seen in the side view of FIG. 6 as shown in FIG. 7.

Each of the depending legs 16 and 18 has a strengthening brace or spar 30 and 32 on each side of the corresponding leg 16 or 18 in a perpendicular manner. This can best be seen in FIG. 7, wherein the strengthening spar opposite spar 32 on leg 18 is designated by the numeral 34 in FIG. 7.

Figure 8:
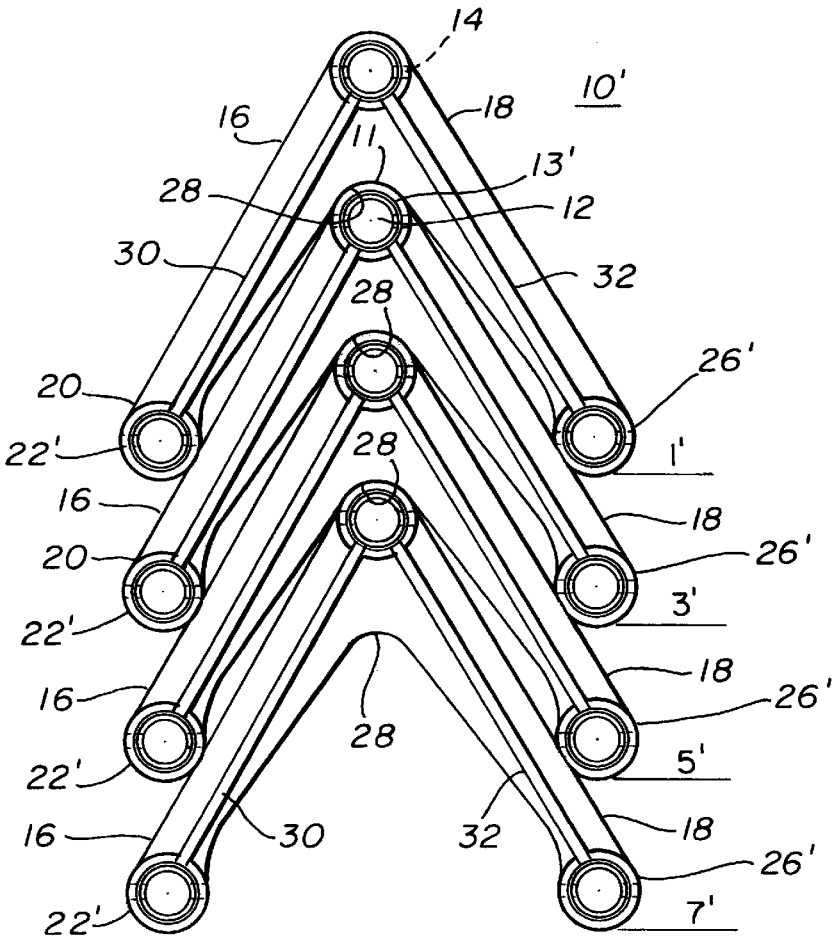
FIG. 8 is a front view of stacked trusses using the former of the second embodiment.

An interior apex 28 is formed so that the trusses that are formed can be stacked as illustrated in FIG. 8.

FIG. 8 is an end view of the stacked trusses 1', 3', 5', and 7'. It will be noted that the apex 11 of each former nests in the interior apex 28 of the adjacent former 10' above it.

Figure 9:
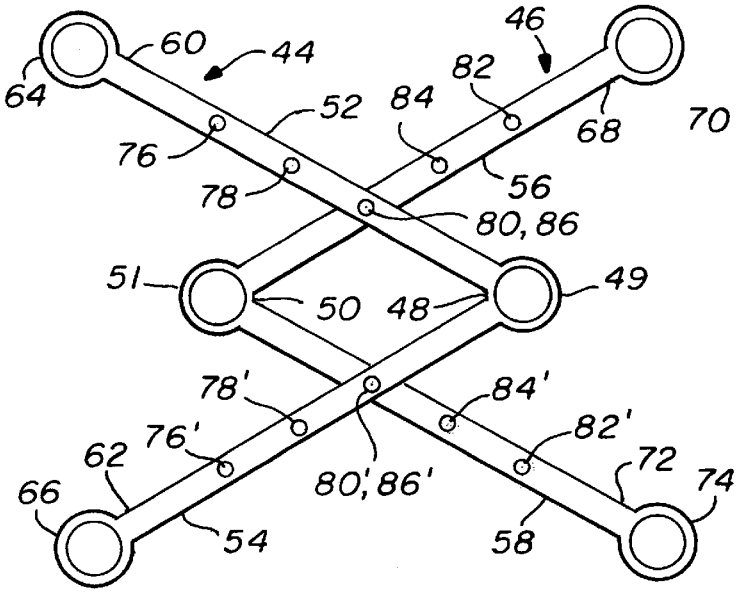
FIG. 9 is a plan view of two V-shaped formers having spaced orifices in the legs so that two of the formers can be placed one upon the other and joined together to form a truss having a first shape.

FIG. 9 is plan view of two V-shaped trusses of the present invention that have flat legs or legs with spaced flattened areas thereon, with spaced orifices in the flattened areas such that one of V-shaped formers or members can be placed over the other with aligned orifices in the legs thereof enabling the two V-shaped formers to be joined together to form a truss of different shapes as viewed from the end. Thus, as can be seen in FIG. 9, V-shaped former 44 is inverted and placed on V-shaped former 46. As can be seen, former 44 has an apex 48 with an bracket device 49 on the end thereof and two depending V-shaped legs 52 and 54. On the outer end 60 of leg 52 there is a bracket 64 and on the outer end 62 of leg 54 there is a bracket 66.

In like manner, V-shaped former 46 has a apex 50 with a bracket member 51 at the apex and two depending legs 56 and 58. On the outer end 68 of leg 56 there is a bracket member 70 and on the outer end 78 of leg 58 there is a bracket member 74.

Each leg of each V-shaped former 44 has a plurality of spaced orifices therein. For instance, in V-shaped former 44, leg 52, there are three spaced orifices 76, 78, and 80. In like manner, in leg 54 of V-shaped former 44 there are three corresponding orifices 76', 78', and 80'. In leg 56 of V-shaped former 46 there are three corresponding spaced orifices 82, 84, and 86. While in leg 58 of V-shaped former 46 there are three corresponding orifices 82', 84', and 86'.

As can be seen in FIG. 9, by placing V-shaped former 44 on V-shaped former 46 and aligning orifices 80 and 86 in legs 52 and 56 and orifices 80' and 86' in legs 54 and 58, bolts or other fastening devices can be placed through the aligned orifices to create a double former such as shown in FIG. 9 to which appropriate elongated chords can be attached as described earlier to form a truss having not only strength and novel structural characteristics but also having a shape that will allow peculiar arrangements of lighting and other components to be placed thereon. Thus, the novel former shown in FIG. 9 enables a plurality of different shaped trusses to be formed. The flat surface or surface area on each of the legs 52, 54, 56, and 58 enables inverted V-shaped formers to placed on one another, first flat surface aligned to first flat surface and at least one orifice in each leg flat surface for receiving a fastener placed in aligned first orifices in the first flat surfaces to connect the inverted V-shaped formers together to create a truss former that enables an elongated truss to be formed having a first shape as shown.

Figure 10:
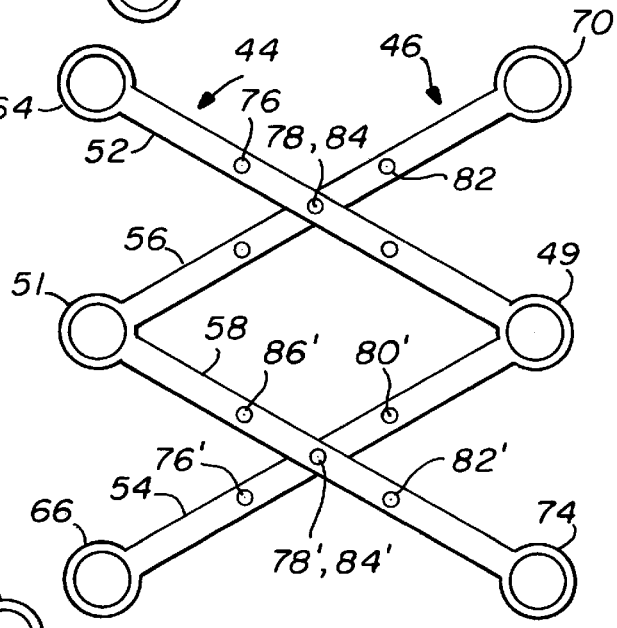
FIG. 10 is a plan view of the two formers of FIG. 9 being coupled together at different leg orifices to form a truss having a second shape.

As can be seen in FIG. 10, a second different shaped former can be created by aligning the central orifices 78 and 84 and 78' and 84'.

Figure 11:
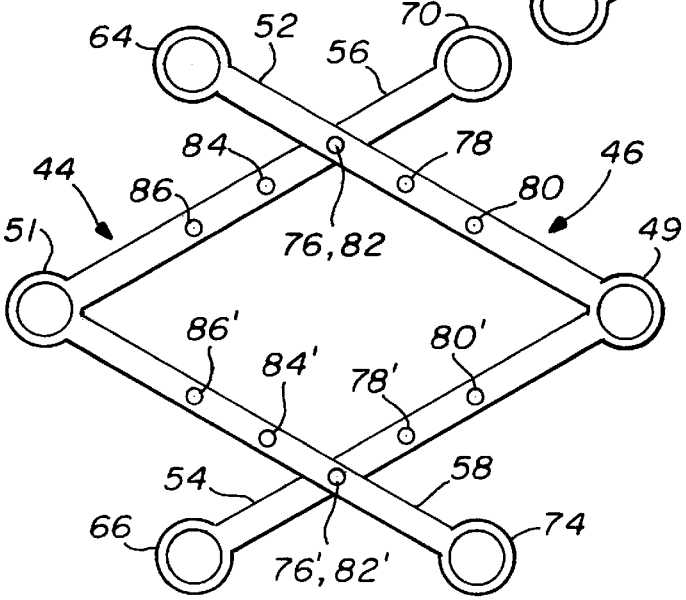
FIG. 11 is a plan view of the two formers of FIG. 9 being coupled together at still different leg orifices to form a truss having a third shape.

Finally, as can be seen in FIG. 11, by aligning the outer orifices 76 and 82 and 76' and 82' a substantially six-sided truss could be created.

Obviously, the number of flat areas and orifices in each leg could be varied to obtain trusses of different outer dimension and shape.

Thus, there has been disclosed a novel former for use in forming an elongated V-shaped truss that has a plurality of the formers and a plurality of associated elongated chords or support members. The generic former comprises a substantially V-shaped body having an apex and two legs depending from the apex, each leg having an outer end. A bracket is formed at the body apex and at each leg outer end for receiving a corresponding elongated support member. The bracket is shown in both the preferred embodiment and the second embodiment to be constructed such that it can receive a tubular chord or support member. Clearly, other shaped elongated support members could be used, (such as I-beams) and the brackets could be shaped to conform to at least a portion of the elongated support member used.

In the preferred embodiment, a plate extends up vertically from an arcuate segment that receives the elongated chord or support member in the form of a tubular member and is inserted in a slot therein. Obviously there can be spaced slots in the tubular member for receiving corresponding vertical plates of a plurality of spaced formers. Orifices in the former plate and aligned orifices in the tubular support member can receive a pin to removably connect the former to the elongated support member.

In another embodiment, the bracket may be in the form of a hollow tubular duct segment having an inside diameter slightly larger than the outer diameter of a corresponding elongated tubular chord or support member for slidably receiving the elongated tubular support member. The formers can then be placed at a desired spacing for strength and the V-shaped truss can be used in the construction of staging. Of course, again, aligned orifices can be formed in the elongated tubular segment at predetermined locations and in the hollow duct segment bracket for the insertion of a pin to removably connect the former to the elongated support members in a rigid manner.

The corresponding structures, materials, acts, and equivalents of all means or step plus function elements in the claims below are intended to include any structure, material, or act for performing the function in combination with other claimed elements as specifically claimed.

I claim:

1. A former for use in assembling and disassembling an elongated truss that has a plurality of said formers and a plurality of elongated support chords, the former comprising:

a substantially V-shaped body having an apex and two legs depending from said apex, each leg having an outer end;

bracket means at the body apex and at each leg outer end for receiving one of said elongated support chords, each of said received elongated support chords being substantially parallel to each other and substantially perpendicular to said V-shaped body; and attachment means for enabling each of said bracket means to be attached to said received one of said elongated support chords such that a plurality of said elongated support chords and a plurality of said formers may be detachably assembled to each other to form a V-shaped stackable truss for storage that may be disassembled for shipping.

2. The former of claim 1 further comprising:

orifices in said bracket means that can be in aligned relationship with orifices in said elongated support chords; and said bracket orifices enabling the receipt of elongated pins inserted in said aligned orifices to detachably connect each of said bracket means to one of said elongated support chords.

3. The former of claim 2 wherein:

said bracket means is a tubular segment having a diameter sufficiently large to slidably receive an elongated tubular support chord.

4. The former of claim 1 further including:

a plate extending outwardly from each of said bracket means for insertion in a corresponding slot in one of said elongated support chords; and orifices in said plate that can be aligned with orifices in a corresponding elongated support chord for receiving removable pins to enable said plate to be detachably connected to said elongated support chord to form a truss that can be disassembled and shipped in the disassembled state to conserve space.

5. The former of claim 1 wherein said bracket means is an arcuate segment having a concave shape that can receive an elongated support chord having a matching convex outer surface.

6. The former of claim 5 further including:

a plate extending outwardly from each of said arcuate segments that can engage a slot in a corresponding one of said elongated support chords; and orifices in each of said vertical plates for receiving pins that hold said elongated support chord attached to said vertical plate.

7. A former usable in assembling a V-shaped stackable support truss formed with elongated support chords, said formers and said support chords enabled to be transported as separate elements comprising:

a substantially V-shaped former having an apex and two legs depending therefrom, each leg having an outer end;

a bracket at the apex and at the outer end of each leg of said former;

each bracket for receiving one of said elongated support chords such that each of said received elongated support chords are substantially parallel to each other and substantially perpendicular to said V-shaped body;

plate on each of said brackets that can be used to engage a received one of said elongated support chords; and orifices in each of said plates that can receive pins for attaching said received ones of said elongated support chords to said plate.

8. A former for enabling a plurality of different shaped trusses to be formed from a plurality of said formers and a plurality of elongated support chords said former comprising:

a substantially V-shaped body having an apex and depending legs with outer ends;

a bracket on said apex and each leg outer end for attachment to one of said plurality of elongated support chords;

each depending leg having at least a first flat surface thereon to enable a first one of said plurality of formers to be inverted and placed on a second one of said plurality of formers, first flat surface aligned to first flat surface; and an orifice in said first flat surface of said first one of said plurality of formers aligned with an orifice in said first flat surface of said second one of said plurality of formers for receiving a fastener placed in said aligned orifices to connect said first and second ones of said plurality of formers together to enable an elongated truss to be formed having a first shape.

9. The former of claim 8 wherein each of said;

depending legs defines a second orifice that is spaced from said first orifice to enable said second orifice of one depending leg to be aligned with said second orifice of a second depending leg; and said second aligned orifices for receiving a fastener to connect said first and second ones of said plurality of formers together to enable an elongated truss to be formed having a second shape.

10. The former of claim 9 further comprising:

a third flat surface on each depending leg spaced from both said first and second surfaces to enable inverted ones of V-shaped formers to be placed on one another, said third flat surfaces being in alignment; and third aligned orifices in said aligned third flat surfaces for receiving a fastener to connect said V-shaped formers together to create a truss former that enables a six-sided elongated truss to be created.

* * * * *